US010444670B2

(12) United States Patent
Mimura

(10) Patent No.: US 10,444,670 B2
(45) Date of Patent: Oct. 15, 2019

(54) TONER CASE AND IMAGE FORMING APPARATUS

(71) Applicant: KYOCERA Document Solutions Inc., Osaka (JP)

(72) Inventor: Daisuke Mimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/836,057

(22) Filed: Dec. 8, 2017

(65) Prior Publication Data

US 2018/0181027 A1 Jun. 28, 2018

(30) Foreign Application Priority Data

Dec. 22, 2016 (JP) ..... 2016-249283

(51) Int. Cl.
*G03G 15/08* (2006.01)
*G03G 21/16* (2006.01)
*G03G 21/18* (2006.01)

(52) U.S. Cl.
CPC ..... *G03G 15/0887* (2013.01); *G03G 15/0868* (2013.01); *G03G 15/0875* (2013.01); *G03G 15/0886* (2013.01); *G03G 21/1647* (2013.01); *G03G 15/087* (2013.01);
(Continued)

(58) Field of Classification Search
CPC ..... G03G 15/087; G03G 21/1864
See application file for complete search history.

(56) References Cited

U.S. PATENT DOCUMENTS 7,242,893 B2 7/2007 Murakami et al.
9,436,126 B1 9/2016 Anderson, Jr. et al.
(Continued)

FOREIGN PATENT DOCUMENTS

EP 2530532 A1 12/2012
EP 3081991 A1 10/2016
(Continued)

OTHER PUBLICATIONS

Extended European Search Report issued by the European Patent Office dated May 18, 2018, which corresponds to EP17206078.2-1022 and is related to U.S. Appl. No. 15/836,057.
(Continued)

*Primary Examiner* — Victor Verbitsky
(74) *Attorney, Agent, or Firm* — Studebaker & Brackett PC

(57) ABSTRACT

A toner case includes a case main body, a rotator, a transmitter, a moving mechanism and a manipulation member. The rotator rotates around a rotation axis. At least a part of the rotator is stored in the case main body. The transmitter is arranged outside the case main body and transmits rotation to the rotator. The manipulation member is arranged outside the case main body. As the manipulation member moves from a first manipulating position to a second manipulating position, the moving mechanism moves the transmitter from a first position to a second position which is arranged at an outside of the first position in a rotation axis direction of the rotator. As the manipulation member moves from the second manipulating position to the first manipulating position, the moving mechanism moves the transmitter from the second position to the first position.

9 Claims, 14 Drawing Sheets

(52) U.S. Cl.
CPC ..... *G03G 15/0865* (2013.01); *G03G 21/186* (2013.01); *G03G 21/1864* (2013.01); *G03G 2221/1657* (2013.01)

(56) References Cited

U.S. PATENT DOCUMENTS

| | | | | |
|---|---|---|---|---|
| 2005/0196184 | A1* | 9/2005 | Koyama ..... | G03G 15/0868 399/27 |
| 2006/0269305 | A1 | 11/2006 | Murakami et al. | |
| 2010/0111574 | A1 | 5/2010 | Ichikawa | |
| 2012/0263504 | A1 | 10/2012 | Nagashima | |
| 2012/0328307 | A1 | 12/2012 | Oda et al. | |
| 2014/0044459 | A1 | 2/2014 | Hotani | |
| 2014/0169838 | A1* | 6/2014 | Nagashima ..... | G03G 15/0865 399/263 |
| 2015/0139688 | A1 | 5/2015 | Leemhuis et al. | |
| 2015/0277281 | A1 | 10/2015 | Mushika et al. | |
| 2015/0338825 | A1 | 11/2015 | Leemhuis et al. | |
| 2016/0154376 | A1 | 6/2016 | Xiao et al. | |

FOREIGN PATENT DOCUMENTS

| | | | |
|---|---|---|---|
| JP | 2001-305841 | A | 11/2001 |
| JP | 2003-162137 | A | 6/2003 |
| JP | 2005-196138 | A | 7/2005 |

OTHER PUBLICATIONS

Extended European Search Report issued by the European Patent Office dated Mar. 27, 2018, which corresponds to EP17206088.1-1022 and is related to U.S. Appl. No. 15/836,057.

Extended European Search Report issued by the European Patent Office dated Apr. 20, 2018, which corresponds to EP17206076.6-1022 and is related to U.S. Appl. No. 15/836,057.

An Office Action issued by the Australian Patent Office dated Aug. 17, 2018, which corresponds to Australian Patent Application No. 2017272313 and is related to U.S. Appl. No. 15/836,199.

An Office Action issued by the Japanese Patent Office dated Jul. 9, 2019, which corresponds to Japanese Patent Application No. 2016-249283 and is related to U.S. Appl. No. 15/836,057; with English translation.

* cited by examiner

TONER CASE AND IMAGE FORMING APPARATUS

INCORPORATION BY REFERENCE

This application is based on and claims the benefit of priority from Japanese patent application No. 2016-249283 filed on Dec. 22, 2016, which is incorporated by reference in its entirety.

BACKGROUND

The present disclosure relates to a toner case and an image forming apparatus including the toner case.

An image forming apparatus, such as a printer, a copying machine, a facsimile and a multifunctional peripheral, includes a toner case which replenishes a developing device with a toner (a developer). For instance, the toner case includes a case main body storing the toner, a rotator stored in the case main body and rotating around a rotation axis and a transmitter arranged outside the case main body and transmitting rotation to the rotator. In such a toner case, by transmitting the rotation from the transmitter to the rotator, the toner in the case main body is agitated or conveyed by the rotator.

SUMMARY

In accordance with an aspect of the present disclosure, a toner case includes a case main body, a rotator, a transmitter, a moving mechanism and a manipulation member. The case main body stores a toner. The rotator rotates around a rotation axis. At least a part of the rotator is stored in the case main body. The transmitter is arranged outside the case main body and transmits rotation to the rotator. The moving mechanism moves the transmitter between a first position and a second position which is arranged at an outside of the first position in a rotation axis direction of the rotator. The manipulation member is arranged outside the case main body and moves between a first manipulating position and a second manipulating position. As the manipulation member moves from the first manipulating position to the second manipulating position, the moving mechanism moves the transmitter from the first position to the second position. As the manipulation member moves from the second manipulating position to the first manipulating position, the moving mechanism moves the transmitter from the second position to the first position.

In accordance with an aspect of the present disclosure, an image forming apparatus includes the toner case and an attachment part to which the toner case is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, one embodiment of the present disclosure will be described with reference to figures.

Figure 1:
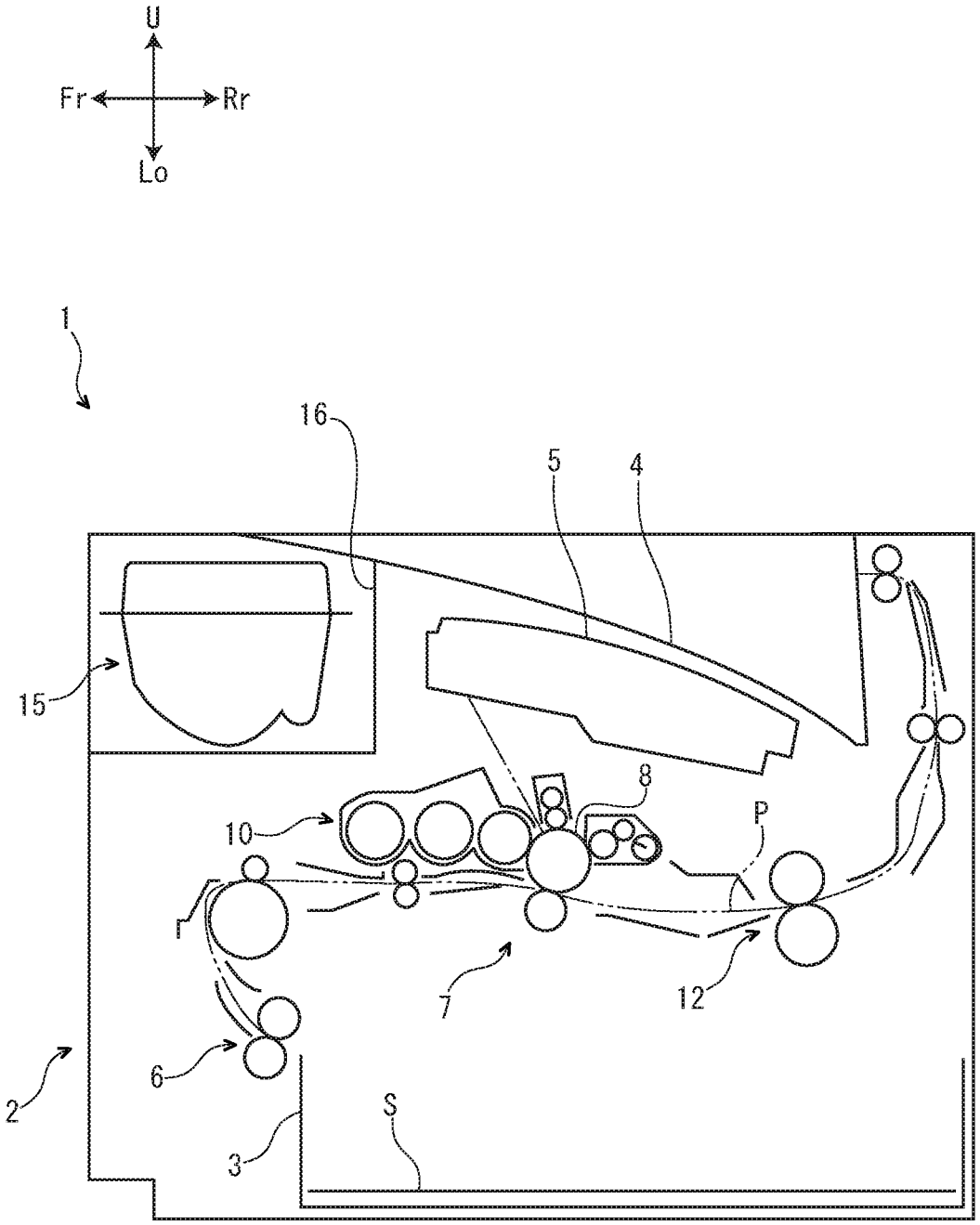
FIG. 1 is a schematic view showing a printer according to one embodiment of the present disclosure.

Firstly, an entire structure of a printer 1 (an example of an image forming apparatus) will be described. In the following description, for convenience of explanation, a left side on FIG. 1 is defined to be a front side of the printer 1. Arrows Fr, Rr, L, R, U and Lo shown in each figure respectively indicate a front side, a rear side, a left side, a right side, an upper side and a lower side of the printer 1.

With reference to FIG. 1, the printer 1 includes a box-shaped printer main body 2 (an example of an apparatus main body). In a lower portion of the printer main body 2, a sheet feeding cassette 3 storing a sheet S (an example of a recording medium) is stored. On an upper face of the printer main body 2, an ejected sheet tray 4 is provided. In an upper portion of the printer main body 2, an exposing device 5 is stored below the ejected sheet tray 4.

Inside the printer main body 2, a conveying path P for the sheet S is provided. At an upstream end of the conveying path P, a sheet feeding part 6 is provided. At a middle portion of the conveying path P, an image forming part 7 is provided. The image forming part 7 includes a photosensitive drum 8 and a developing device 10. At a downstream portion of the conveying path P, a fixing device 12 is provided.

In a front upper portion of the printer main body 2, a toner container 15 (an example of a toner case) is stored. The toner container 15 is detachably attached to an attachment part 16.

Next, an operation of the printer 1 having the above described configuration will be described.

Firstly, laser light (refer to a two-dotted line in FIG. 1) emitted from the exposing device 5 exposes the photosensitive drum 8 to form an electrostatic latent image on the photosensitive drum 8. Next, the electrostatic latent image on the photosensitive drum 8 is developed by the developing device 10 to a toner image. Thereby, an image forming operation is finished.

On the other hand, the sheet S fed from the sheet feeding cassette 3 by the sheet feeding part 6 is conveyed to the image forming part 7 synchronously with the above described image forming operation. At the image forming part 7, the above toner image is transferred on the sheet S from the photosensitive drum 8. The sheet S on which the toner image is transferred is conveyed to the downstream side along the conveying path P and enters the fixing device 12. The fixing device 12 fixes the toner image on the sheet S. The sheet S on which the toner image is fixed is ejected on the ejected sheet tray 4 from a downstream end of the conveying path P.

Next, the toner container 15 will be described in detail.

Figure 2:
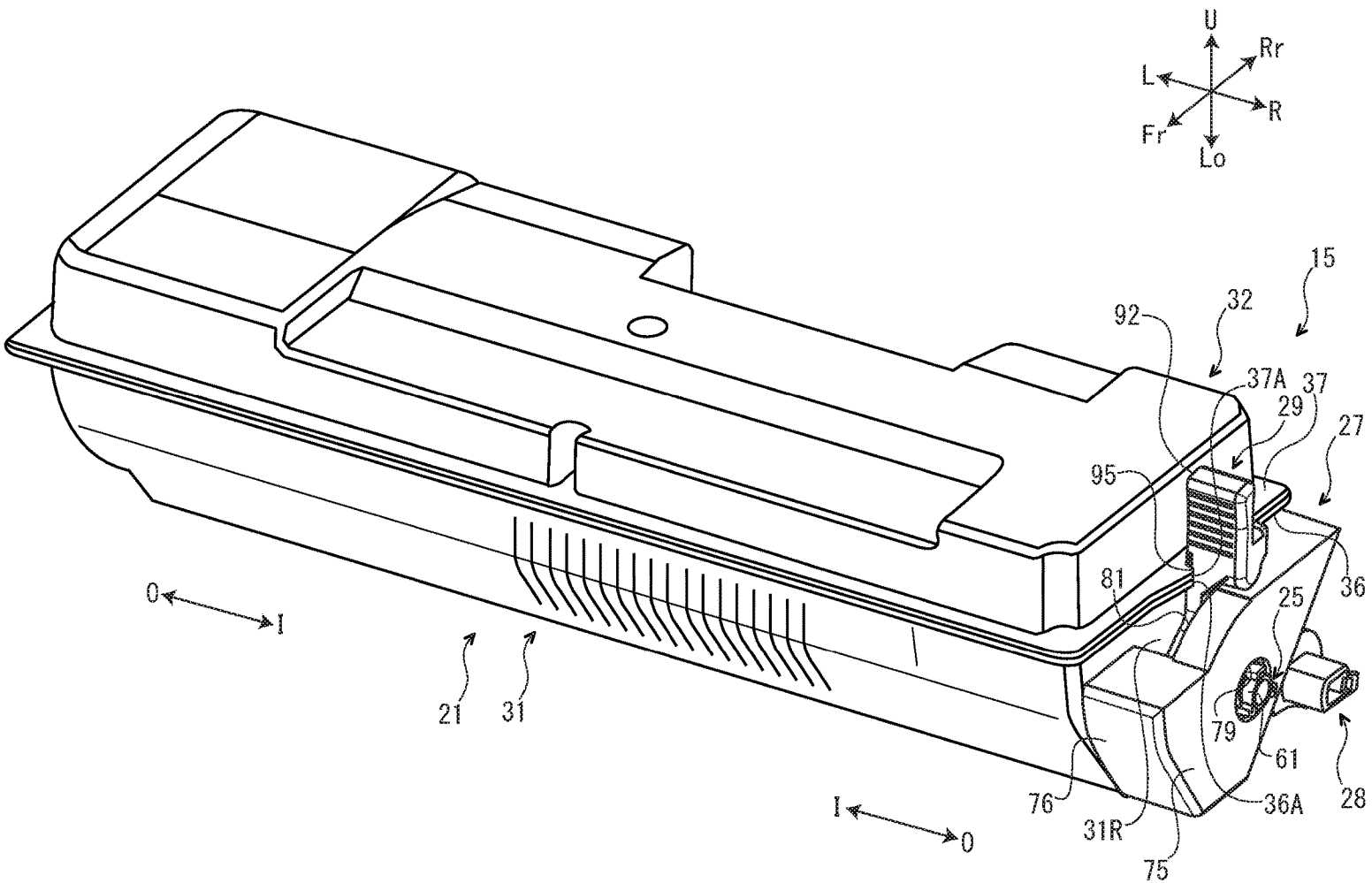
FIG. 2 is a perspective view showing a toner container according to the one embodiment of the present disclosure.

An arrow O shown in each figure after FIG. 2 indicates an outside in the left-and-right direction of the toner container 15, and an arrow I shown in each figure after FIG. 2 indicates an inside in the left-and-right direction of the toner container 15.

Figure 3:
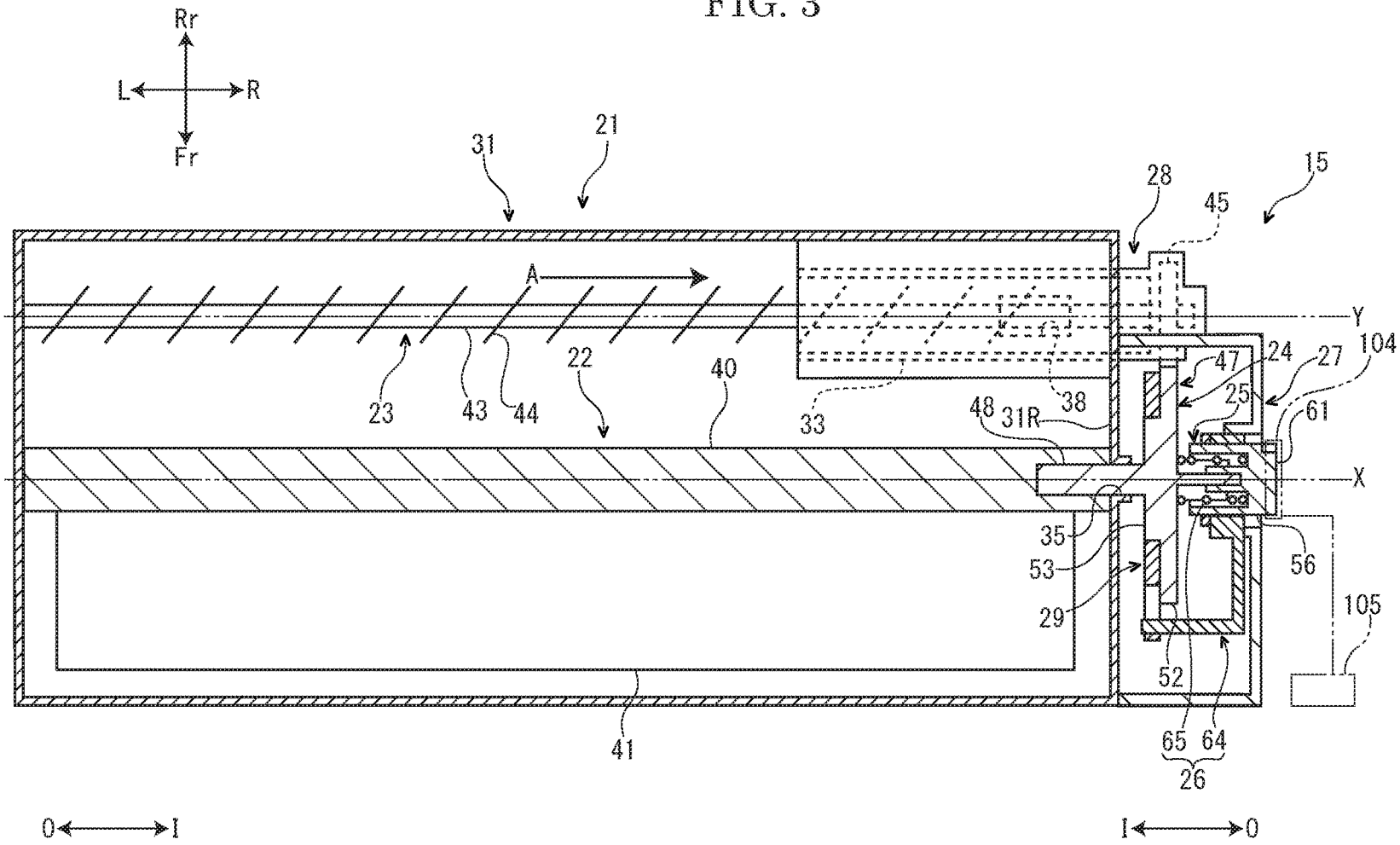
FIG. 3 is a sectional view schematically showing the toner container according to the one embodiment of the present disclosure.

With reference to FIG. 2 and FIG. 3, the toner container 15 includes a case main body 21, an agitator 22 (an example of a rotator) stored in a center portion of the case main body 21, a conveyer 23 (an example of a rotator) stored in a rear lower portion of the case main body 21, a supporter 24 arranged at a right end side of the case main body 21, a transmitter 25 and a moving mechanism 26 which are arranged at a right side (the outside in the left-and-right direction) of the supporter 24, a cover 27 covering a right side (the outside in the left-and-right direction) of the case main body 21, a shutter 28 arranged at a rear lower side of a right end portion of the case main body 21 and a manipulation member 29 arranged at a right side (the outside in the left-and-right direction) of the case main body 21.

The case main body 21 of the toner container 15 has a shape elongated in the left-and-right direction. The case main body 21 stores the toner (the developer). The case main body 21 includes a storage 31, a lid 32 provided at an upper side of the storage 31 and a duct 33 provided at a rear lower side of a right end portion of the storage 31.

The storage 31 of the case main body 21 is formed in a box-like shape whose upper side is opened. In a center portion of a right side wall 31R of the storage 31, a supporting hole 35 is provided. Around an upper end of an outer circumference of the storage 31, a lower side flange portion 36 is provided. On a center of a right end portion of the lower side flange portion 36, a lower side protrusion 36A is protruded to the right side (the outside in the left-and-right direction)

The lid 32 of the case main body 21 is formed in a box-like shape whose lower side is opened. Around a lower end of an outer circumference of the lid 32, an upper side flange portion 37 is provided. The upper side flange portion 37 is fixed to the lower side flange portion 36 of the storage 31. Thereby, the lid 32 is integrated with the storage 31. An inner space of the lid 32 is communicated with an inner space of the storage 31. On a center of a right end portion of the upper side flange portion 37, an upper side protrusion 37A is protruded to the right side (the outside in the left-and-right direction) at a position corresponding to the lower side protrusion 36A of the lower side flange portion 36.

The duct 33 of the case main body 21 is formed in a cylindrical shape extending in the left-and-right direction. The duct 33 is formed integrally with the storage 31. An inner space of the duct 33 is communicated with the inner space of the storage 31. In a lower face of the duct 33, a discharge port 38 through which the toner is discharged is provided.

With reference to FIG. 3, the agitator 22 of the toner container 15 is stored in the storage 31 of the case main body 21. The agitator 22 is rotatable around a first rotation axis X extending along the left-and-right direction. That is, the left-and-right direction is a rotation axis direction of the agitator 22 in the present embodiment. The agitator 22 includes an agitating shaft 40 extending along the left-and-right direction and an agitating blade 41 mounted to the agitating shaft 40. The agitating blade 41 is made of resin film, for example, and formed in a sheet-like shape.

A portion between a left end portion and a center portion in the left-and-right direction of the conveyer 23 of the toner container 15 is stored in the storage 31 of the case main body 21. Aright side portion of the conveyer 23 is stored in the duct 33 of the case main body 21. A right end portion of the conveyer 23 is protruded to the right side (the outside in the left-and-right direction) of the duct 33, and exposed to an outside of the case main body 21. The conveyer 23 is rotatable around a second rotation axis Y extending along the left-and-right direction. That is, the left-and-right direction is a rotation axis direction of the conveyer 23.

The conveyer 23 includes a conveying shaft 43 extending along the left-and-right direction, a spiral conveying fin 44 protruding on an outer circumference of the conveying shaft 43 and a driven gear 45 fixed to the right end portion (the portion exposed to the outside of the case main body 21) of the conveying shaft 43.

Figure 4:
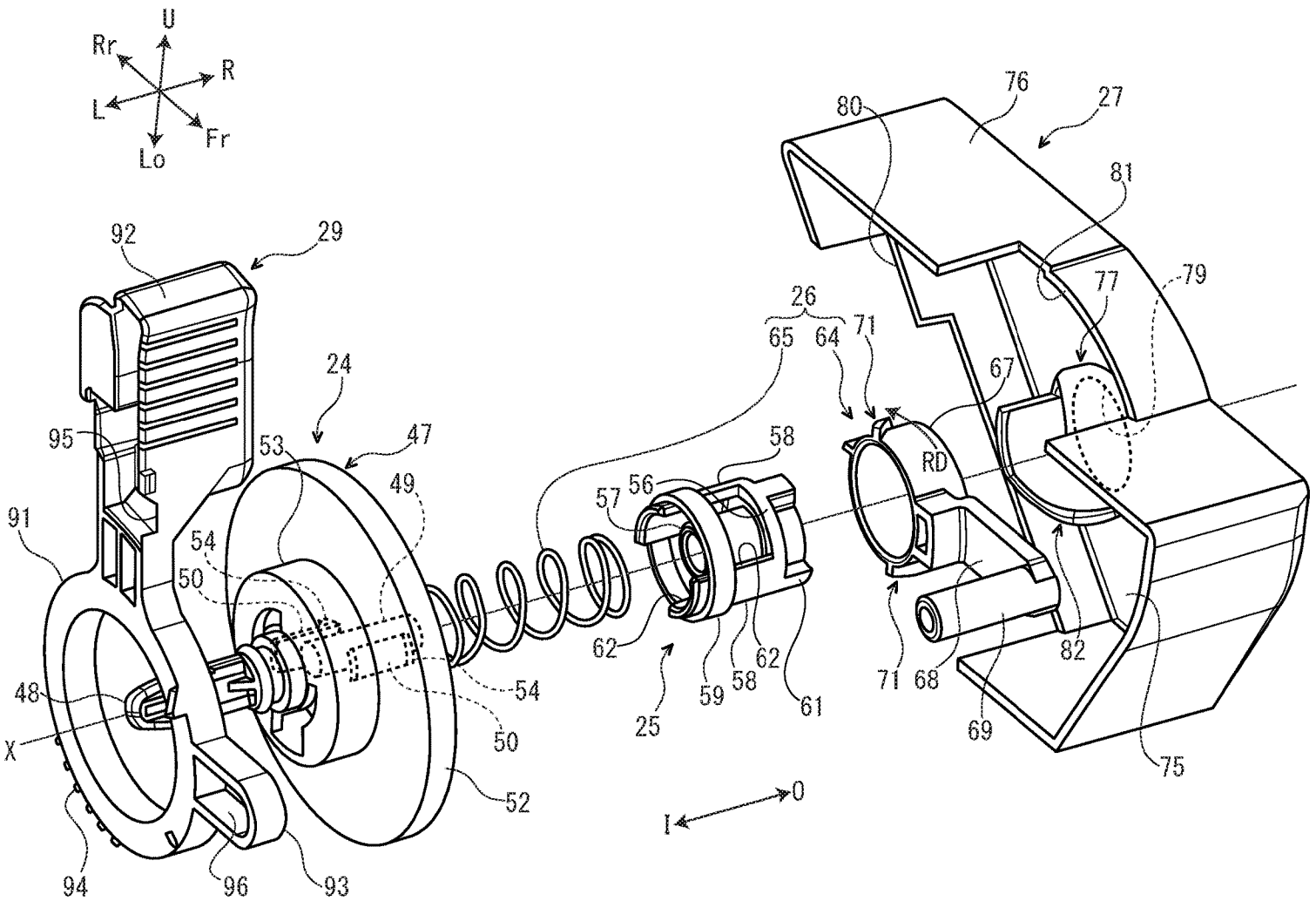
FIG. 4 is a disassembled perspective view showing a supporter, a transmitter, a moving mechanism, a cover and a manipulation member, in the toner container according to the one embodiment of the present disclosure.

With reference to FIG. 4, the supporter 24 of the toner container 15 includes an annular exposed piece 47, a coupling piece 48 protruding from a center portion of the exposed piece 47 to the left side (the inside in the left-and-right direction), a boss piece 49 protruding from the center portion of the exposed piece 47 to the right side (the outside in the left-and-right direction) and a pair of inserted pieces 50 protruding from the exposed piece 47 at an outer circumference of the boss piece 49 to the right side (the outside in the left-and-right direction).

With reference to FIG. 3, the exposed piece 47 of the supporter 24 is arranged at the right side (the outside in the left-and-right direction) of the storage 31 of the case main body 21, and exposed to the outside of the case main body 21. Around an outer circumferential face of the exposed piece 47, a driving gear 52 is provided. The driving gear 52 is meshed with the driven gear 45 of the conveyer 23. Thereby, the supporter 24 is connected to the conveyer 23. On a left face (a face at the inside in the left-and-right direction) of the exposed piece 47, a platform 53 is protruded.

The coupling piece 48 of the supporter 24 penetrates through the supporting hole 35 provided in the right side wall 31R of the storage 31 of the case main body 21. Thereby, the supporter 24 is rotatably supported by the case main body 21. A tip end portion of the coupling piece 48 is inserted into an inside of the storage 31, and fixed to a right end portion of the agitating shaft 40 of the agitator 22.

Thereby, the supporter 24 is connected to the agitator 22, and rotatable integrally with the agitator 22 around the first rotation axis X.

With reference to FIG. 4, at a right end portion (an end portion at the outside in the left-and-right direction) of each inserted piece 50 of the supporter 24, a hook 54 is provided. The hook 54 is protruded to an outside in a radial direction (a direction separated from the first rotation axis X).

Figure 5:
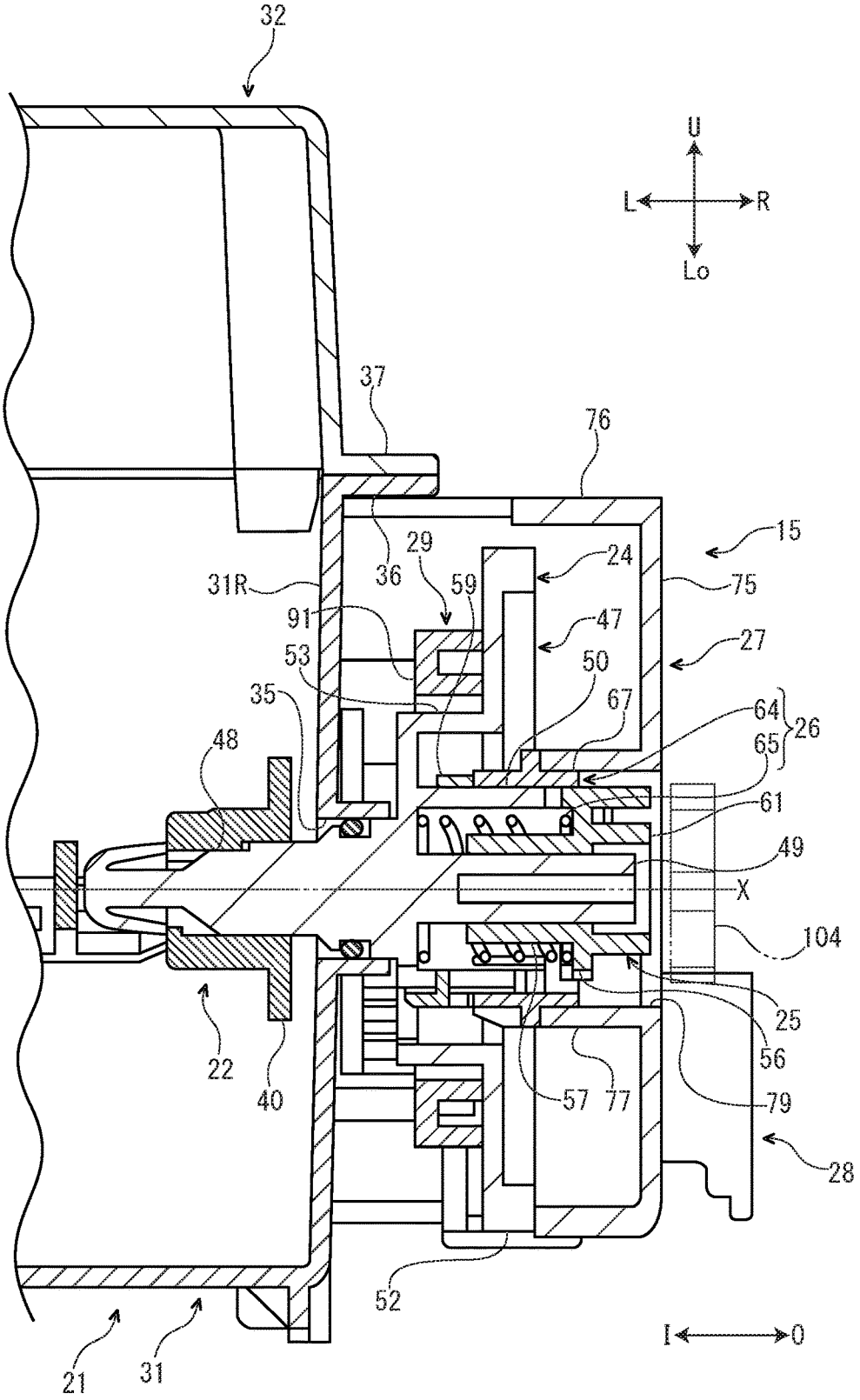
FIG. 5 is a sectional view showing a state where the transmitter is in a first position, in the toner container according to the one embodiment of the present disclosure.
Figure 6:
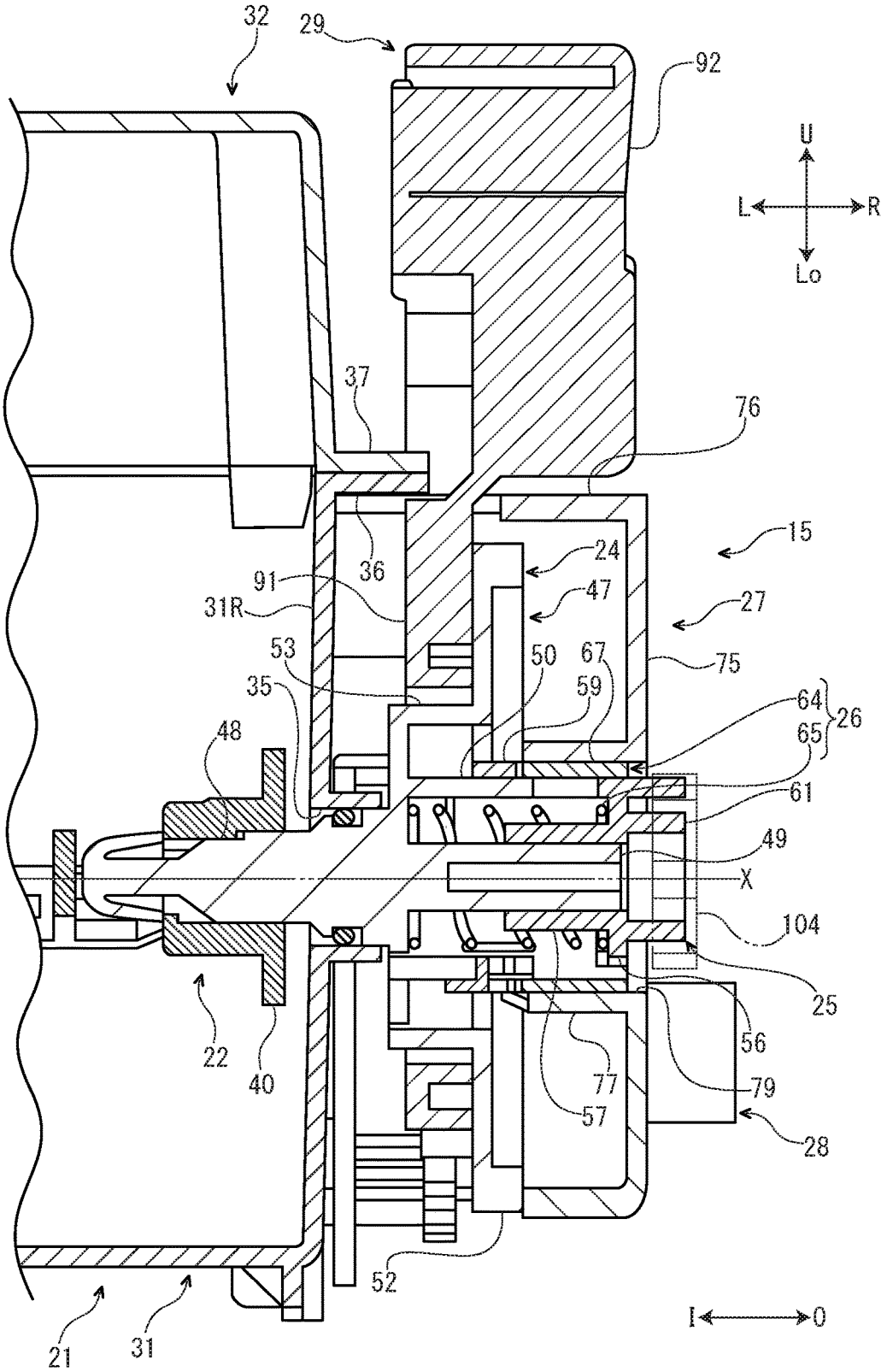
FIG. 6 is a sectional view showing a state where the transmitter is in a second position, in the toner container according to the one embodiment of the present disclosure.

With reference to FIG. 5 and FIG. 6, the transmitter 25 of the toner container 15 is arranged at the right side (the outside in the left-and-right direction) of the storage 31 of the case main body 21 and outside the case main body 21. The transmitter 25 moves linearly along the left-and-right direction between a first position (refer to FIG. 5) and a second position (refer to FIG. 6) which is arranged at the right side (the outside in the left-and-right direction) of the first position.

With reference to FIG. 4, the transmitter 25 includes a transmitting piece 56, a cylindrical piece 57 protruding from a center portion of the transmitting piece 56 to the left side (the inside in the left-and-right direction), a pair of protruding pieces 58 protruding from the transmitting piece 56 at an outer circumference of the cylindrical piece 57 to the left side (the inside in the left-and-right direction) and an approximate annular fixing piece 59 fixed to outer circumferential faces of left side portions of the pair of protruding pieces 58. On a right face (a face at the outside in the left-and-right direction) of the transmitting piece 56, a transmitting coupling 61 is provided. Into the cylindrical piece 57, the boss piece 49 of the supporter 24 is inserted. A pair of inserting grooves 62 is formed between the pair of protruding pieces 58. Into each inserting groove 62, each inserted piece 50 of the supporter 24 is inserted. According to the configuration described above, the transmitter 25 is supported by the supporter 24 in a state where the transmitter 25 is movable along the left-and-right direction and is not rotatable with respect to the supporter 24. The fixing piece 59 engagingly locks the hook 54 of each inserted piece 50. This inhibits each inserted piece 50 from being removed from each inserting groove 62.

The moving mechanism 26 of the toner container 15 includes a holder 64 and a coil spring 65 (an example of a biasing member).

With reference to FIG. 7 to FIG. 10, the holder 64 of the moving mechanism 26 rotates around the first rotation axis X between a first holding position (refer to FIG. 7 and FIG. 8) where the holder 64 holds the transmitter 25 in the first position and a second holding position (refer to FIG. 9 and FIG. 10) where the holder 64 holds the transmitter 25 in the second position. An arrow RD shown in each figure indicates a rotating direction of the holder 64 from the first holding position to the second holding position (hereinafter, called as "a rotating direction RD").

With reference to FIG. 4, the holder 64 includes a base part 67, an arm part 68 extending linearly from an outer circumferential face of the base part 67 to an outside in a radial direction (a direction separated from the first rotation axis X) and a boss part 69 extending linearly from an outer end portion of the arm part 68 at the outside in the radial direction to the left side (the inside in the left-and-right direction).

The base part 67 of the holder 64 is formed in a cylindrical shape with the first rotation axis X as an axis center. Into an inner circumference of the base part 67, the pair of protruding pieces 58 of the transmitter 25 is rotatably inserted. Thereby, the base part 67 holds the transmitter 25 rotatably. A left edge portion (an edge portion at the inside in the left-and-right direction) of the base part 67 comes into contact with the fixing piece 59 of the transmitter 25.

Figure 8:
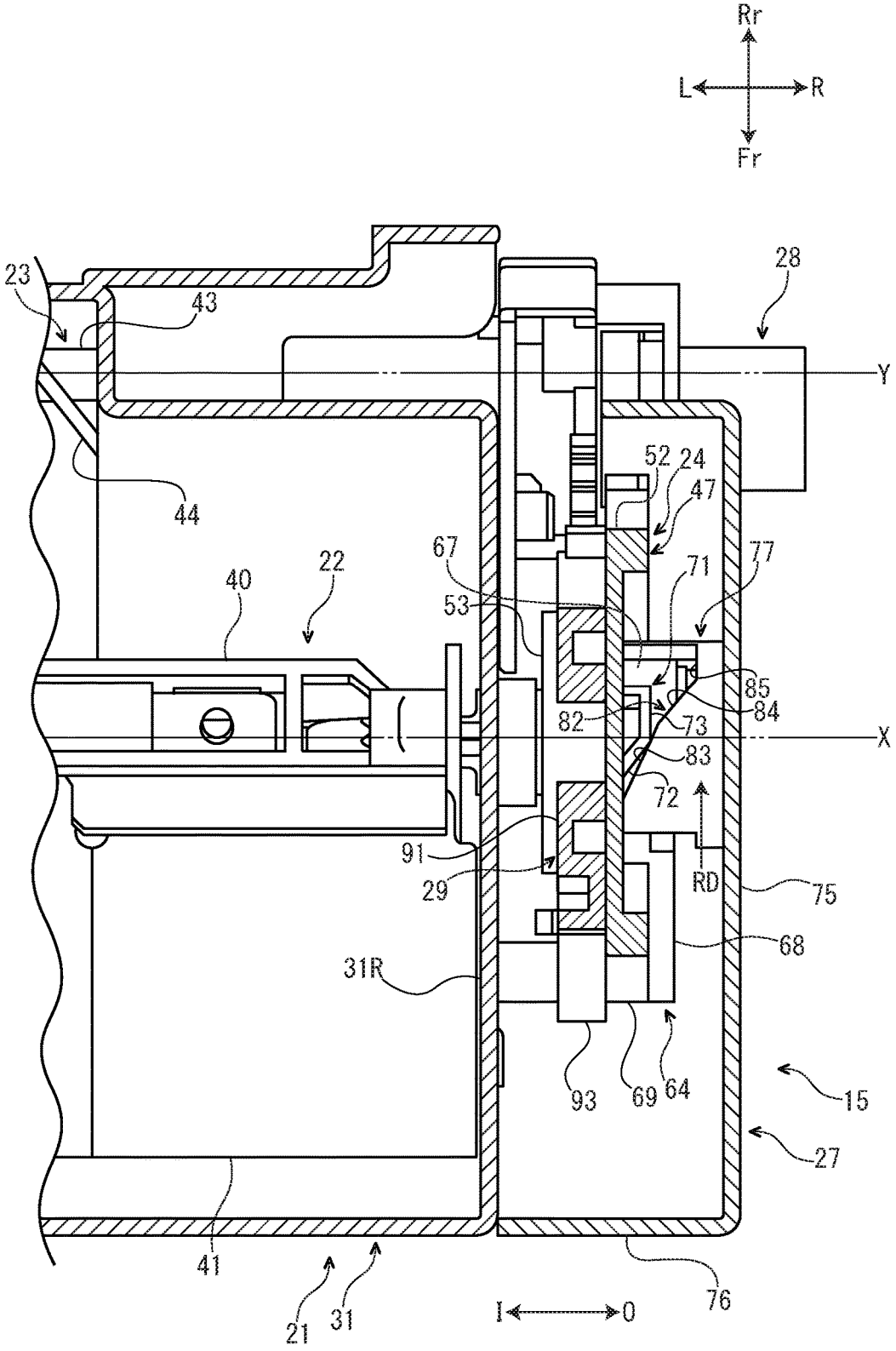
FIG. 8 is a sectional view showing the state where the holder is in the first holding position, in the toner container according to the one embodiment of the present disclosure.
Figure 10:
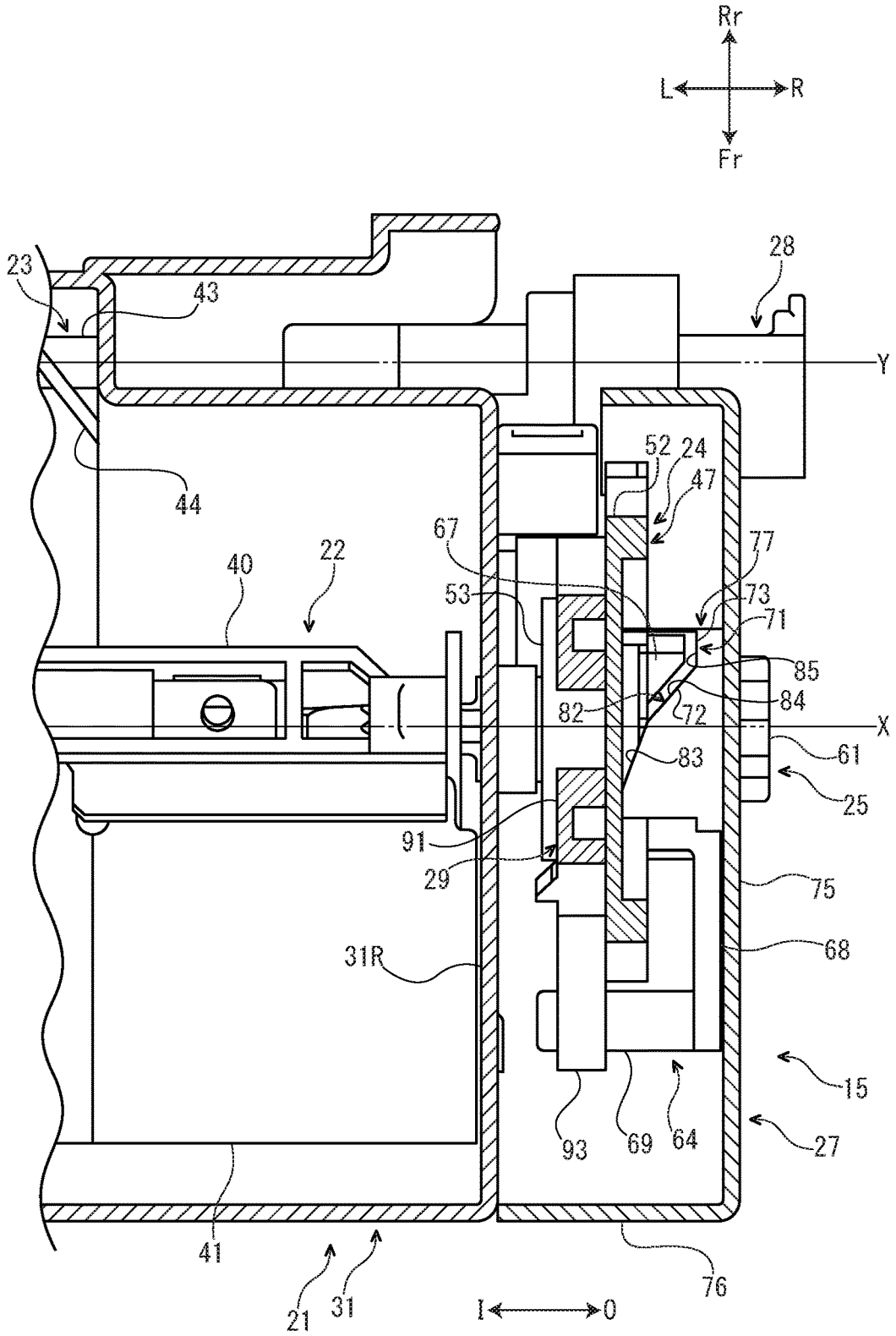
FIG. 10 is a sectional view showing the state where the holder is in the second holding position, in the toner container according to the one embodiment of the present disclosure.

With reference to FIG. 8 and FIG. 10, on an outer circumferential face of the base part 67 of the holder 64, a pair of guided parts 71 (only one of them, the one at a near side on the figure, is shown in FIG. 8 and FIG. 10) is protruded. Each guided part 71 includes an inclined piece 72 and a non-inclined piece 73 provided at a downstream side of the inclined piece 72 in the rotating direction RD. The inclined piece 72 is inclined to the right side (the outside in the left-and-right direction) from the upstream side to the downstream side in the rotating direction RD. The non-inclined piece 73 is provided along the rotating direction RD.

With reference to FIG. 5 and FIG. 6, the coil spring 65 of the moving mechanism 26 is interposed between the exposed piece 47 of the supporter 24 and the transmitting piece 56 of the transmitter 25. The coil spring 65 is attached to an outer circumference of the cylindrical piece 57 of the transmitter 25. The coil spring 65 presses the transmitter 25 to the right side (the outside in the left-and-right direction) to bias the transmitter 25 to the second position (refer to FIG. 6) and to bias the holder 64 to the second holding position (refer to FIG. 9 and FIG. 10).

With reference to FIG. 4, the cover 27 of the toner container 15 includes a plate-shaped main wall 75, a circumferential wall 76 arranged at an outer circumference side of the main wall 75 and a guide wall 77 arranged at a center side of the main wall 75.

The main wall 75 of the cover 27 is provided along a plane crossing the first rotation axis X. In a center portion of the main wall 75, a circular through hole 79 is provided.

In a rear portion of the circumferential wall 76 of the cover 27, an exposing groove 80 is provided. Through the exposing groove 80, apart of the driving gear 52 of the supporter 24 is exposed to the outside of the cover 27. In an upper portion of the circumferential wall 76, a notch 81 is provided.

The guide wall 77 of the cover 27 is formed in a cylindrical shape. The guide wall 77 is protruded from the main wall 75 at an outer circumference of the through hole 79 to the left side (the inside in the left-and-right direction). Into the guide wall 77, the base part 67 of the holder 64 is inserted. Thereby, the cover 27 supports the holder 64 rotatably.

With reference to FIG. 8 and FIG. 10, on a left edge portion (an edge portion at the inside in the left-and-right direction) of the guide wall 77 of the cover 27, a pair of guide parts 82 (only one of them, the one at the near side on the figure, is shown in FIG. 8 and FIG. 10) is provided. Each guide part 82 includes an upstream side inclined part 83, a downstream side inclined part 84 provided at the downstream side of the upstream side inclined part 83 in the rotating direction RD and a non-inclined part 85 provided at the downstream side of the downstream side inclined part 84 in the rotating direction RD. The upstream side inclined part 83 and the downstream side inclined part 84 are inclined to the right side (the outside in the left-and-right direction) from the upstream side to the downstream side in the rotating direction RD. An inclined degree of the upstream side inclined part 83 to the rotating direction RD is smaller than an inclined degree of the inclined piece 72 of each guided part 71 provided in the base part 67 of the holder 64 to the rotating direction RD. An inclined degree of the downstream side inclined part 84 to the rotating direction RD is the same as the inclined degree of the inclined piece 72 to the rotating direction RD. The non-inclined part 85 is provided along the rotating direction RD.

Figure 11:
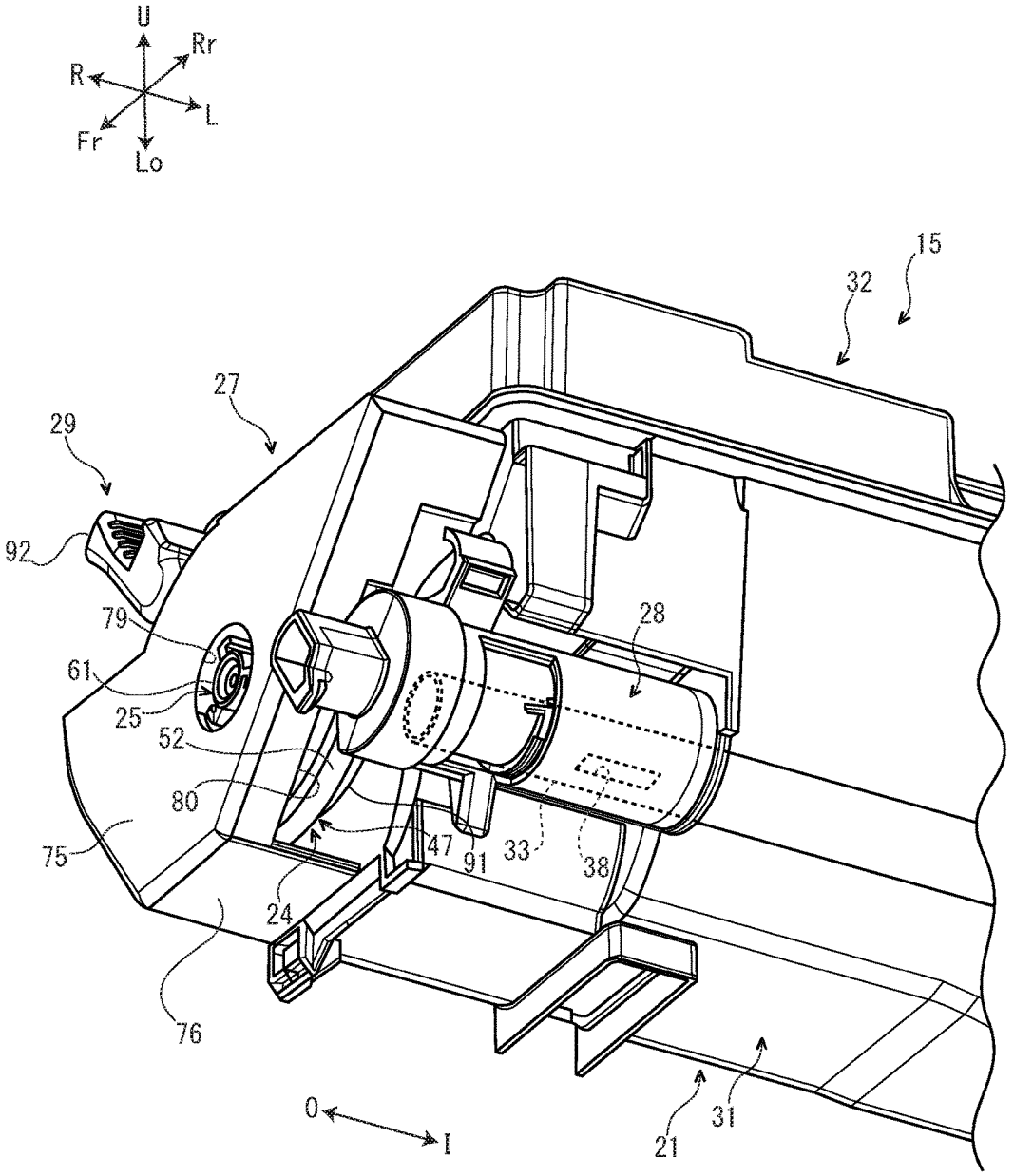
FIG. 11 is a perspective view showing a state where a shutter is in a closing position, in the toner container according to the one embodiment of the present disclosure.
Figure 12:
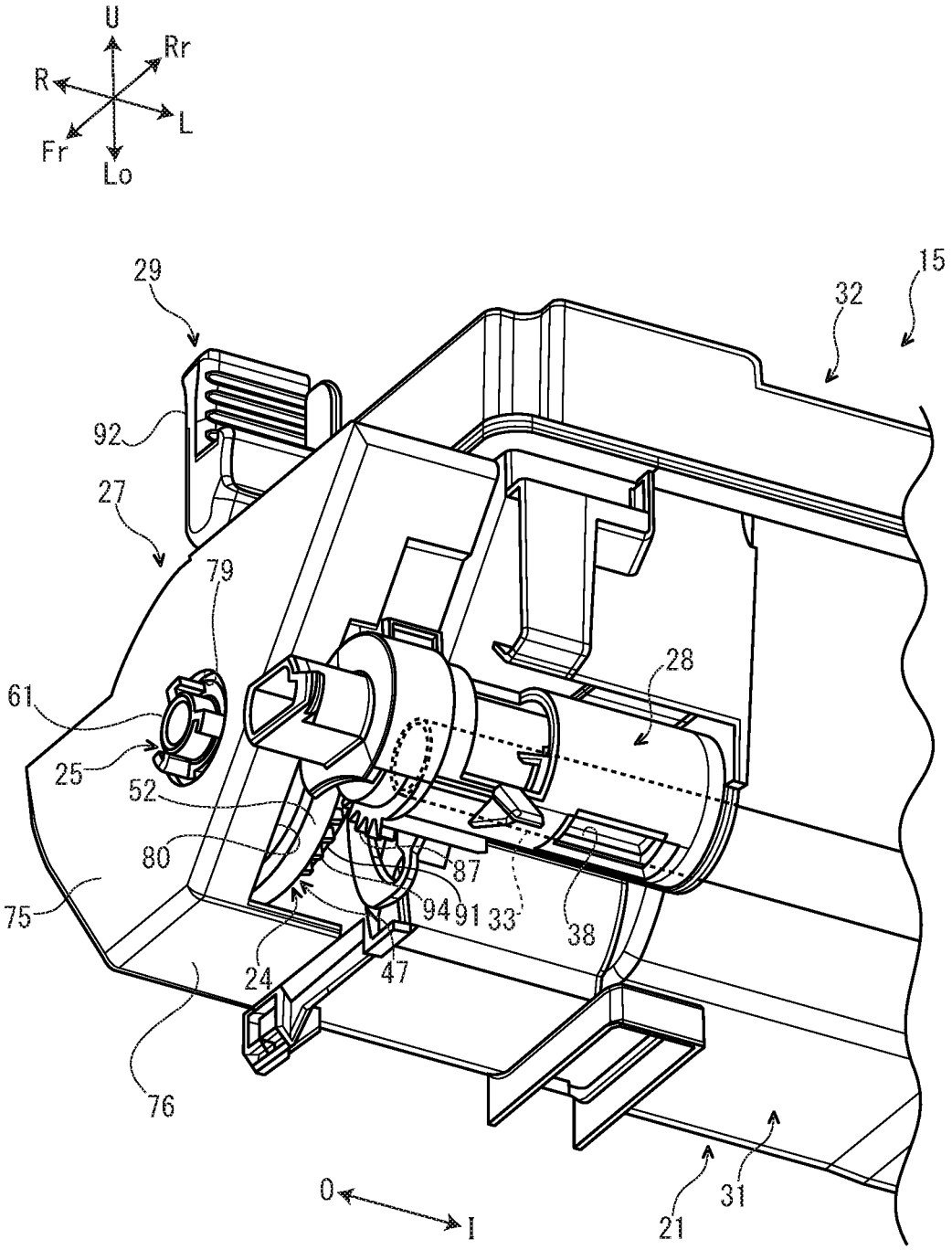
FIG. 12 is a perspective view showing a state where the shutter is in an opening position, in the toner container according to the one embodiment of the present disclosure.

With reference to FIG. 11 and FIG. 12, the shutter 28 of the toner container 15 is formed in an approximate cylindrical shape. The shutter 28 is rotatably attached to an outer circumference of the duct 33 of the case main body 21. The shutter 28 is rotatable between a closing position (refer to FIG. 11) where the shutter 28 closes the discharge port 38 of the duct 33 and an opening position (refer to FIG. 12) where the shutter 28 opens the discharge port 38 of the duct 33. Around an outer circumferential face of the shutter 28, a shutter side gear 87 is provided.

Figure 7:
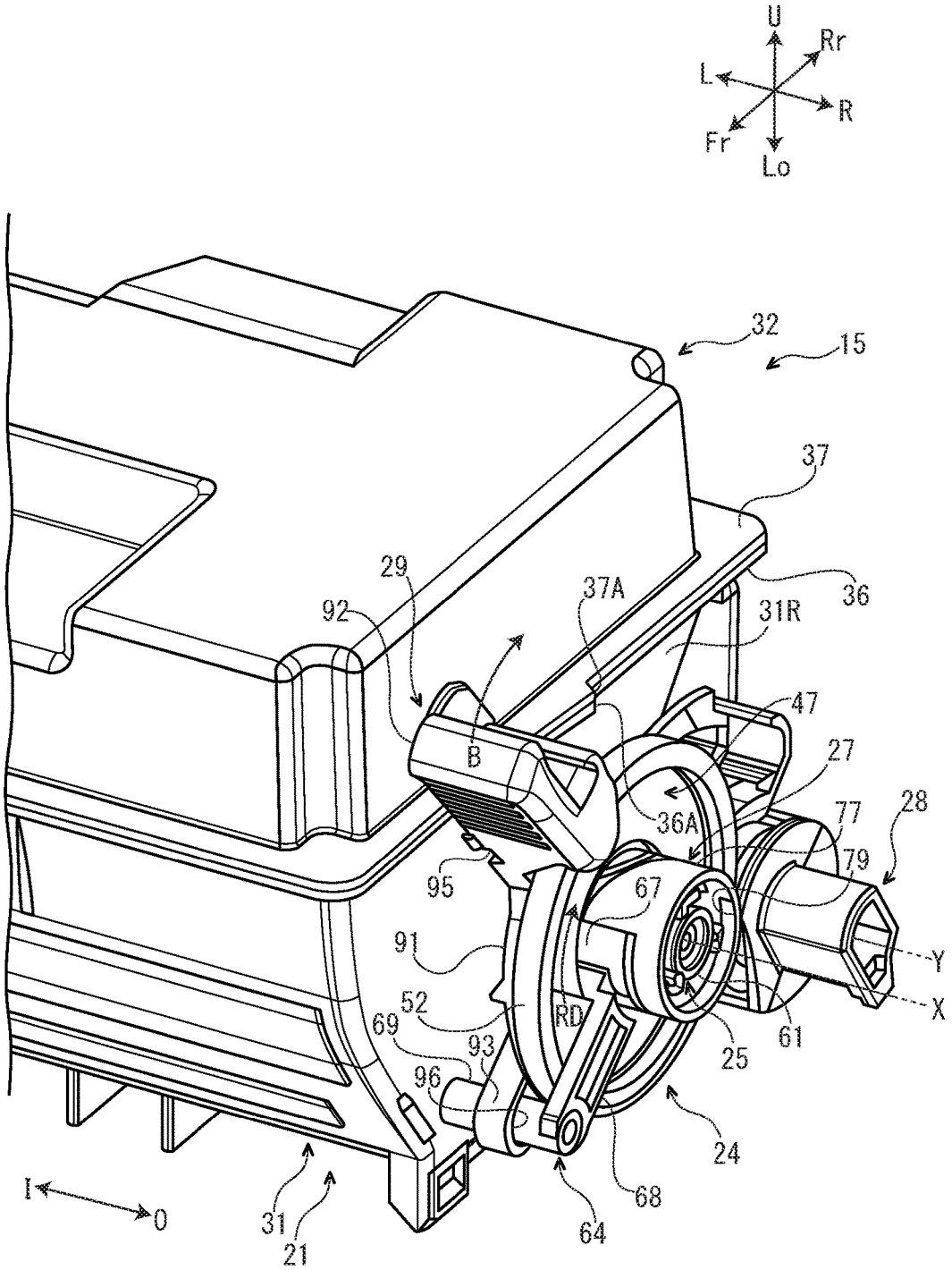
FIG. 7 is a perspective view showing a state where a holder is in a first holding position, in the toner container according to the one embodiment of the present disclosure.
Figure 9:
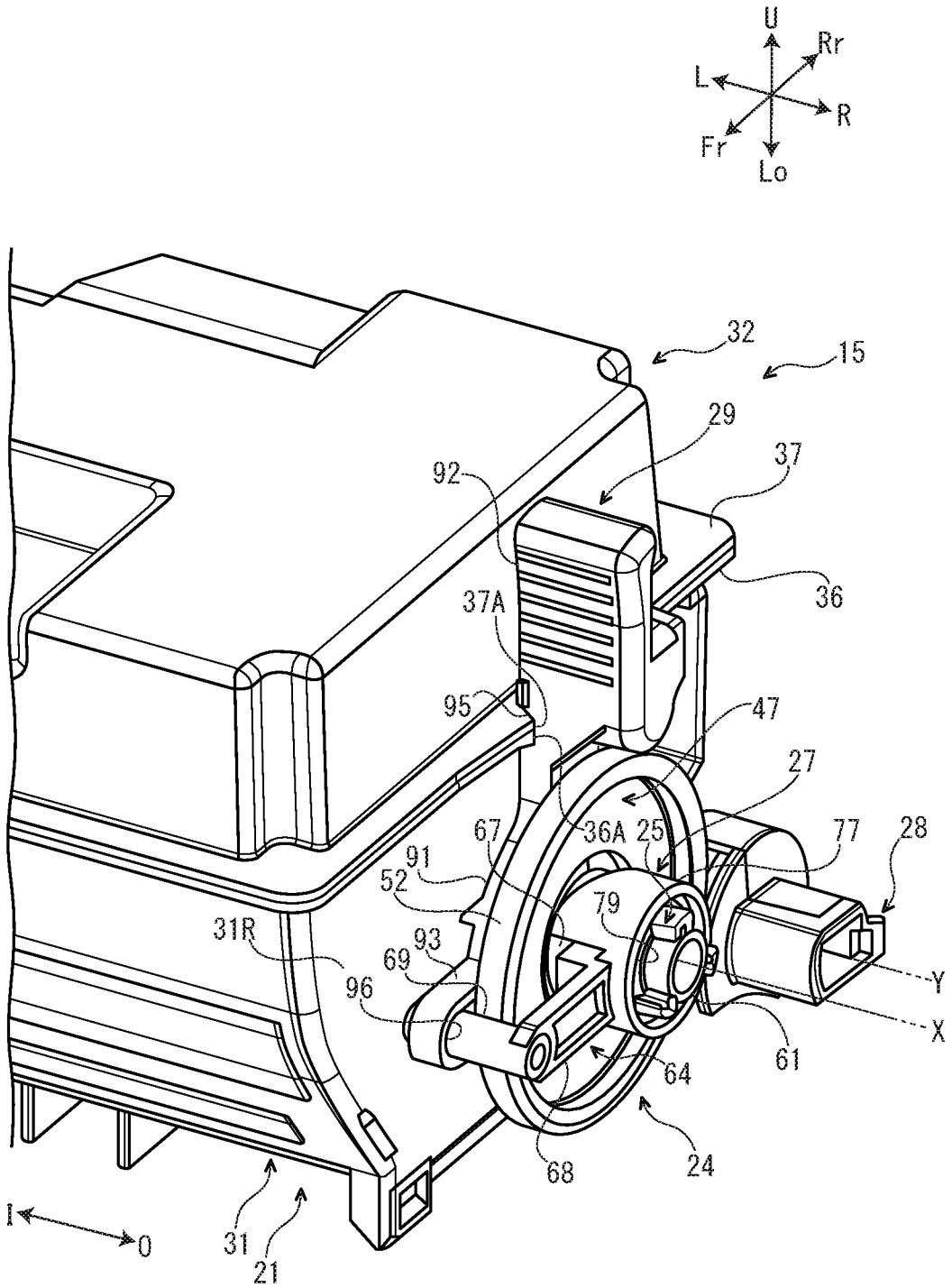
FIG. 9 is a perspective view showing a state where the holder is in a second holding position, in the toner container according to the one embodiment of the present disclosure.

With reference to FIG. 7 and FIG. 9, the manipulation member 29 of the toner container 15 is arranged at the right side (the outside in the left-and-right direction) of the storage 31 of the case main body 21 and outside the case main body 21. The manipulation member 29 is rotatable around the first rotation axis X between a first manipulating position (refer to FIG. 7) and a second manipulating position (refer to FIG. 9).

With reference to FIG. 4, the manipulation member 29 includes a main body part 91, a manipulated part 92 extending linearly from an outer circumferential face of the main body part 91 to an outside in a radial direction (a direction separated from the first rotation axis X) and a pressing part 93 extending linearly from the outer circumferential face of the main body part 91 to the outside in the radial direction (the direction separated from the first rotation axis X).

The main body part 91 of the manipulation member 29 is formed in an annular shape with the first rotation axis X as a center. The main body part 91 is rotatably attached to an outer circumference of the platform 53 of the exposed piece 47 of the supporter 24. Thereby, the manipulation member 29 is rotatably supported by the supporter 24. On a rear lower portion of the outer circumferential face of the main body part 91, a manipulation member side gear 94 is provided. With reference to FIG. 12, the manipulation member side gear 94 is meshed with the shutter side gear 87 of the shutter 28.

With reference to FIG. 2, the manipulated part 92 of the manipulation member 29 is manipulated by a worker, such as a user or a serviceman, when the manipulation member 29 is rotated. An upper portion of the manipulated part 92 is exposed to the upper side of the cover 27 through the notch 81 of the circumferential wall 76 of the cover 27. With reference to FIG. 7 and FIG. 9, in a front lower portion of the manipulated part 92, an engaging groove 95 is provided. The engaging groove 95 is configured such that the engaging groove 95 is not engaged with the protrusions 36A and 37A of the flange portions 36 and 37 in a state where the manipulation member 29 is in the first manipulating position (refer to FIG. 7) and is engaged with the protrusions 36A and 37A of the flange portions 36 and 37 in a state where the manipulation member 29 is in the second manipulating position (refer to FIG. 9).

With reference to FIG. 4, the pressing part 93 of the manipulation member 29 is formed in a laterally laid U-shape. The pressing part 93 is shifted by 90 degree with respect to the manipulated part 92. In an inner circumference of the pressing part 93, an engaging hole 96 is provided. With reference to FIG. 7 and FIG. 9, into the engaging hole 96, the boss part 69 of the holder 64 is engaged.

Next, the attachment part 16 will be described in detail.

Figure 13:
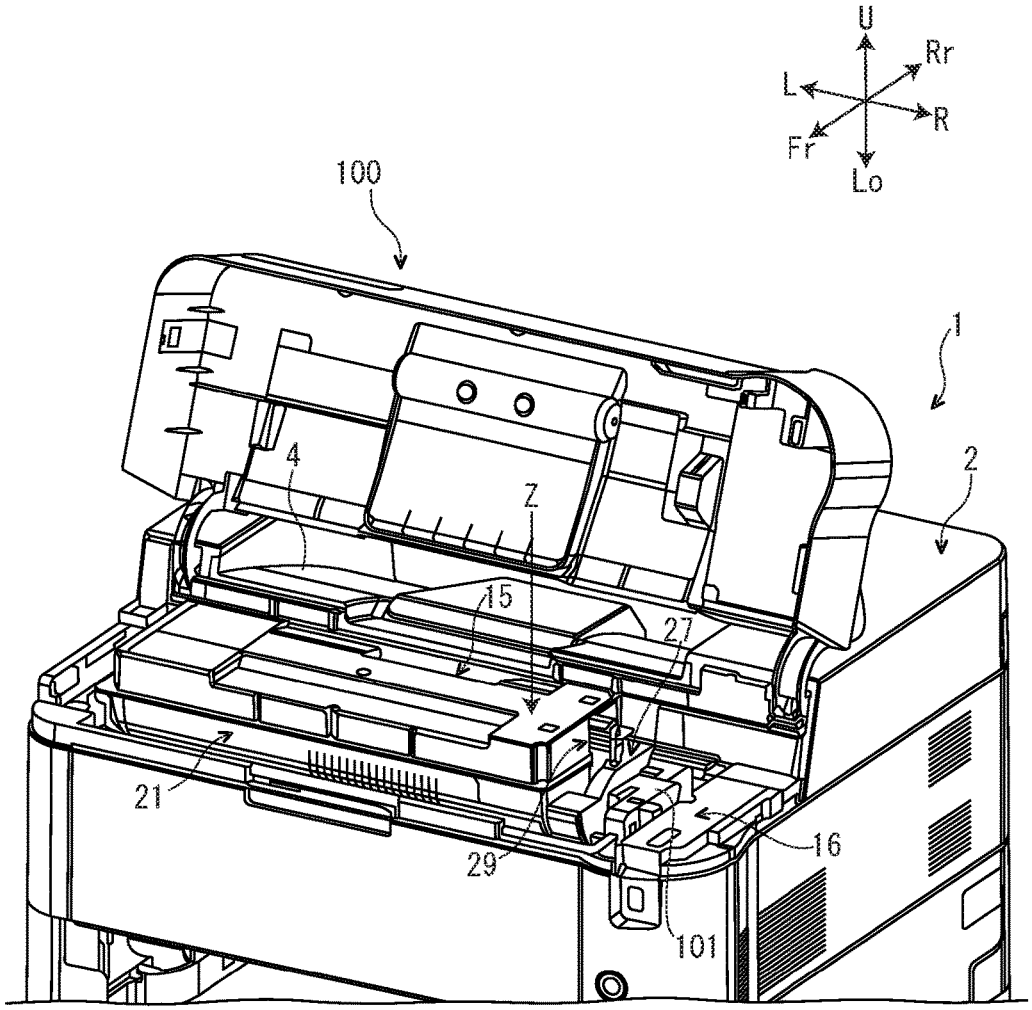
FIG. 13 is a perspective view showing a state where a top cover is opened, in the printer according to the one embodiment of the present disclosure.

With reference to FIG. 13, an upper side of the attachment part 16 is covered with an openable and closable top cover 100. By opening the top cover 100, it becomes possible to attach and detach the toner container 15 to and from the attachment part 16. To the attachment part 16, the toner container 15 is detachably attached along an attachment direction Z from the upper side to the lower side.

Figure 14:
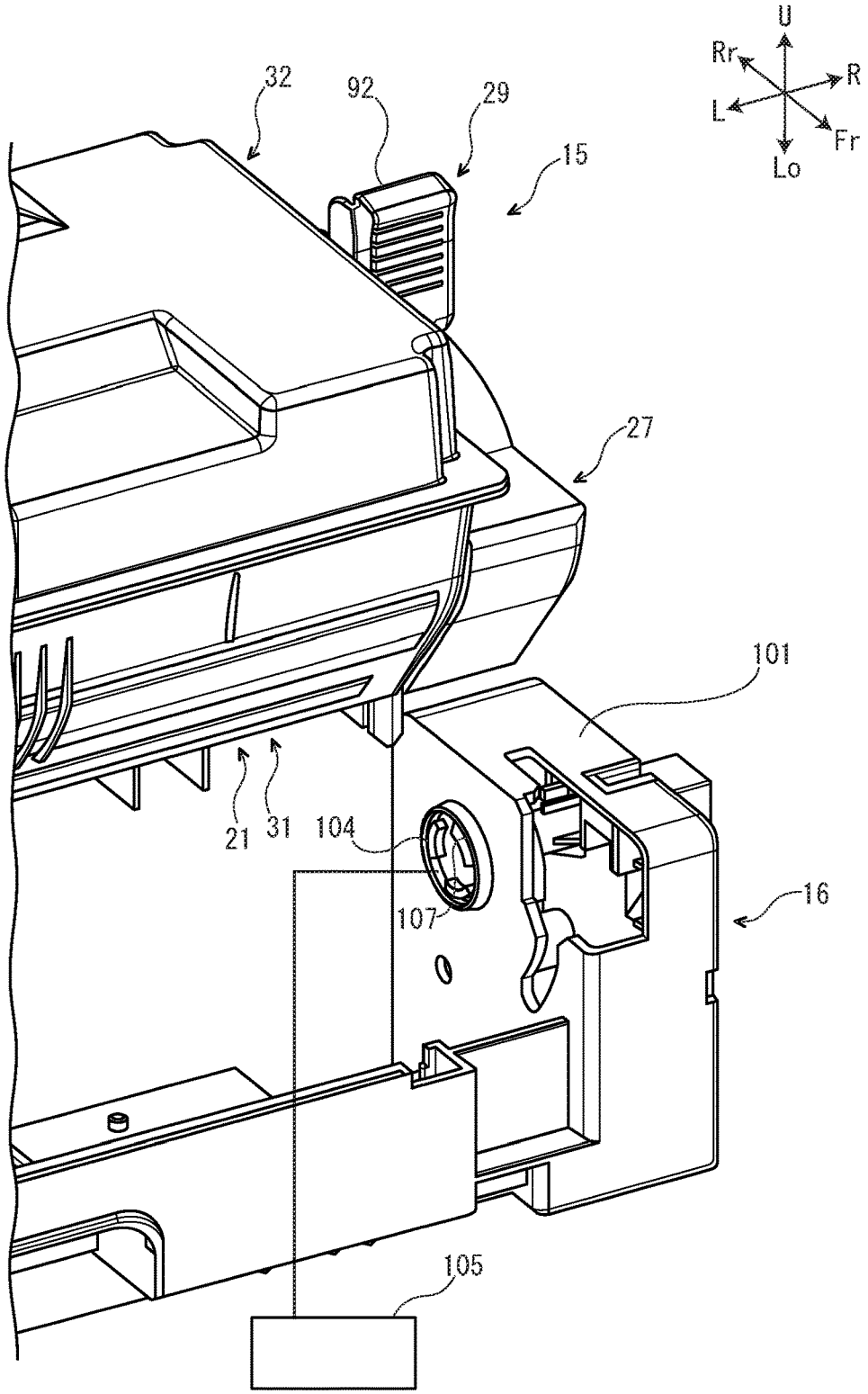
FIG. 14 is a perspective view showing the toner container and an attachment part, in the printer according to the one embodiment of the present disclosure.

With reference to FIG. 14, the attachment part 16 includes a case 101 and a driving coupling 104 stored in an upper portion of the case 101.

The case 101 of the attachment part 16 is arranged at a right end side of the attachment part 16. In an upper portion of an inner face of the case 101, a circular attachment hole 107 is provided.

The driving coupling 104 of the attachment part 16 is rotatably attached to an inner circumference of the attachment hole 107 of the case 101. The driving coupling 104 is exposed to an outside of the case 101 through the attachment hole 107. The driving coupling 104 is connected to a driving source 105 constituted by a motor and the others.

Next, operation to discharge the toner from the toner container 15 will be described.

With reference to FIG. 3, when the toner is discharged from the toner container 15, in a state where the transmitting coupling 61 of the transmitter 25 is coupled to the driving coupling 104 and the discharge port 38 of the duct 33 is opened, the driving source 105 is driven. When the driving source 105 is driven, the driving coupling 104 is rotated by rotation driving force from the driving source 105. When the driving coupling 104 is thus rotated, rotation of the driving coupling 104 is transmitted to the agitator 22 by the transmitter 25 and the supporter 24, and the agitator 22 is rotated. As a result, the toner stored in the storage 31 of the case main body 21 is agitated by the agitator 22.

When the driving coupling 104 is rotated as described above, the rotation is transmitted to the conveyer 23 by the transmitter 25 and the supporter 24, and the conveyer 23 is rotated. As a result, as shown in an arrow A in FIG. 3, the toner stored in the storage 31 and the duct 33 of the case main body 21 is conveyed by the conveyer 23 toward the discharge port 38 of the duct 33. The toner thus conveyed toward the discharge port 38 of the duct 33 is discharged through the discharge port 38 of the duct 33 to the outside of the toner container 15. The toner discharged to the outside of the toner container 15 is replenished to the developing device 10 (refer to FIG. 1).

Next, operation to set the toner container 15 to the attachment part 16 by a worker, such as a user and a serviceman, will be described.

In a state where the toner container 15 is detached from the attachment part 16, the manipulation member 29 is arranged in the first manipulating position (refer to FIG. 7), the pressing part 93 of the manipulation member 29 presses the boss part 69 of the holder 64, and the holder 64 is held in the first holding position (refer to FIG. 7 and FIG. 8). Consequently, a boundary portion between the inclined piece 72 and the non-inclined piece 73 of the guided part 71 of the holder 64 comes into contact with the upstream side inclined part 83 of the guide part 82 of the cover 27. Consequently, the transmitter 25 is held in the first position (refer to FIG. 5) by the holder 64, and the transmitting coupling 61 of the transmitter 25 is retracted to an inside of the through hole 79 of the cover 27. In this state, an entire part of the transmitter 25 is retracted to an inside of the cover 27. The shutter 28 is arranged in the closing position (see FIG. 11).

When the worker sets the toner container 15 to the attachment part 16, the worker inserts the toner container 15 to the attachment part 16 along the attachment direction Z. Consequently, the transmitting coupling 61 of the transmitter 25 faces the driving coupling 104.

Next, as shown in an arrow B in FIG. 7, the worker presses the manipulated part 92 of the manipulation member 29 to the rear side. This pressing rotates the manipulation member 29 from the first manipulating position (refer to FIG. 7) to the second manipulating position (refer to FIG. 9). Consequently, the pressing of the holder 64 to the first holding position (refer to FIG. 7 and FIG. 8) by the manipulation member 29 is released, and the holder 64 rotates from the first holding position (refer to FIG. 7 and FIG. 8) to the second holding position (refer to FIG. 9 and FIG. 10) by biasing force of the coil spring 65. At this time, the pressing part 93 of the manipulation member 29 may press the boss part 69 of the holder 64 to assist the biasing force of the coil spring 65. That is, when "the holder 64 rotates from the first holding position to the second holding position by the biasing force of the coil spring 65", the holder 64 may rotate from the first holding position to the second holding position by the biasing force of the coil spring 65 only, or, the holder 64 may rotate from the first holding position to the second holding position by the biasing force of the coil spring 65 and the pressing force applied to the boss part 69 of the holder 64 by the pressing part 93 of the manipulation member 29.

As the holder 64 rotates from the first holding position to the second holding position as described above, the inclined piece 72 of the guided part 71 of the holder 64 moves along the downstream side inclined part 84 of the guide part 82 of the cover 27, and the inclined piece 72 and the non-inclined piece 73 of the guided part 71 respectively come into contact with the downstream side inclined part 84 and the non-inclined part 85 of the guide part 82. Consequently, the holder 64 moves to the right side (the outside in the left-and-right direction), and the transmitter 25 held by the holder 64 moves from the first position (refer to FIG. 5) to the second position (refer to FIG. 6). As a result, the transmitting coupling 61 of the transmitter 25 protrudes to the right side (the outside in the left-and-right direction) further than the through hole 79 of the cover 27, and is coupled to the driving coupling 104.

Additionally, as the manipulation member 29 is rotated from the first manipulating position (refer to FIG. 7) to the second manipulating position (refer to FIG. 9), the rotation of the manipulation member 29 is transmitted to the shutter 28, and the shutter 28 rotates from the closing position (refer to FIG. 11) to the opening position (refer to FIG. 12). As a result, the discharge port 38 of the duct 33 is opened. Thereby, the setting of the toner container 15 to the attachment part 16 is completed.

On the other hand, when the toner container 15 is detached from the attachment part 16, the worker presses the manipulated part 92 of the manipulation member 29 to the front side. This pressing rotates the manipulation member 29 from the second manipulating position (refer to FIG. 9) to the first manipulating position (refer to FIG. 7). Consequently, the pressing part 93 of the manipulation member 29 presses the boss part 69 of the holder 64, and the holder 64 rotates from the second holding position (refer to FIG. 9 and FIG. 10) to the first holding position (refer to FIG. 7 and FIG. 8) against the biasing force of the coil spring 65. Consequently, the inclined piece 72 of the guided part 71 of the holder 64 moves along the downstream side inclined part 84 of the guide part 82 of the cover 27, and the boundary portion between the inclined piece 72 and the non-inclined piece 73 comes into contact with the upstream side inclined part 83 of the guide part 82. Consequently, the holder 64 moves to the left side (the inside in the left-and-right direction), and the transmitter 25 held by the holder 64 moves from the second position (refer to FIG. 6) to the first position (refer to FIG. 5). As a result, the transmitting coupling 61 of the transmitter 25 is retracted to the inside of the through hole 79 of the cover 27, and the coupling of the transmitting coupling 61 to the driving coupling 104 is released.

Additionally, as the manipulation member 29 is rotated from the second manipulating position (refer to FIG. 9) to the first manipulating position (refer to FIG. 7) as describe above, the rotation of the manipulation member 29 is transmitted to the shutter 28, and the shutter 28 rotates from the opening position (refer to FIG. 12) to the closing position (refer to FIG. 11). As a result, the discharge port 38 of the duct 33 is closed. Thereby, the detachment of the toner container 15 from the attachment part 16 is completed.

The toner container 15 according to the present embodiment includes the moving mechanism 26 which moves the transmitter 25 between the first position and the second position and the manipulation member 29 rotating between the first manipulating position and the second manipulating position. In such a configuration, as the manipulation member 29 is rotated from the first manipulating position to the second manipulating position, the moving mechanism 26 moves the transmitter 25 from the first position to the second position. On the other hand, as the manipulation member 29 is rotated from the second manipulating position to the first manipulating position, the moving mechanism 26 moves the transmitter 25 from the second position to the first position. By applying such a configuration, it becomes possible to move the transmitter 25 along the left-and-right direction by a simple structure and to reduce the worker's load for the attachment and detachment work of the toner container 15.

Additionally, as the manipulation member 29 is rotated from the first manipulating position to the second manipulating position, the holder 64 rotates from the first holding position to the second holding position by the biasing force of the coil spring 65. On the other hand, as the manipulation member 29 is rotated from the second manipulating position to the first manipulating position, the manipulation member 29 presses the holder 64, and the holder 64 rotates from the second holding position to the first holding position against the biasing force of the coil spring 65. By applying such a configuration, it becomes possible to rotate the holder 64 between the first holding position and the second holding position by a simple structure.

Additionally, as the manipulation member 29 is rotated from the second manipulating position to the first manipulating position, the pressing part 93 of the manipulation member 29 presses the boss part 69 of the holder 64. By applying such a configuration, the holder 64 can be surely pressed by the manipulation member 29.

Additionally, the base part 67 of the holder 64 is inserted in the guide wall 77 of the cover 27. By applying such a configuration, the holder 64 can be supported by the cover 27 rotatably by using a simple structure.

Additionally, the upstream side inclined part 83 and the downstream side inclined part 84 of the guide part 82 of the cover 27 are inclined to the right side (the outside in the left-and-right direction) from the upstream side to the downstream side in the rotating direction RD, and the holder 64 includes the guided part 71 coming into contact with the upstream side inclined part 83 and the downstream side inclined part 84. By applying such a configuration, it becomes possible to move the holder 64 in the left-and-right direction surely as the holder 64 rotates.

Additionally, the transmitter 25 is supported by the supporter 24 in the state where the transmitter 25 is movable along the left-and-right direction and is not rotatable with respect to the supporter 24, and the coil spring 65 is interposed between the supporter 24 and the transmitter 25. By applying such a configuration, it becomes possible to integrate the supporter 24, the transmitter 25 and the coil spring 65 and to arrange them in a narrow space.

Additionally, as the manipulation member 29 is rotated from the first manipulating position to the second manipulating position, the shutter 28 rotates from the closing position to the opening position. On the other hand, as the manipulation member 29 is rotated from the second manipulating position to the first manipulating position, the shutter 28 rotates from the opening position to the closing position. By applying such a configuration, the manipulating of the manipulation member 29 makes it possible to perform both operations to couple the transmitting coupling 61 to the driving coupling 104 and to open the discharge port 38 of the duct 33 so that the worker's load can be reduced.

Additionally, the printer 1 includes the toner container 15 and the attachment part 16 to which the toner container 15 is detachably attached. By applying such a configuration, it becomes possible to replace the toner container 15 easily.

By the way, in some cases, with an opening and closing operation of the top cover 100 provided in the printer main body 2 or the attachment operation of the toner container 15 to the attachment part 16, the driving coupling 104 is moved to be coupled to the transmitting coupling 61. However, to achieve such a configuration, the attachment part 16 requires a driving mechanism to move the driving coupling 104, and therefore, the attachment part 16 may be complicated in its structure.

However, in the present embodiment, as the manipulation member 29 is rotated from the first manipulating position to the second manipulating position, the moving mechanism 26 moves the transmitter 25 from the first position to the second position, and the transmitting coupling 61 is coupled to the driving coupling 104. By applying such a configuration, the attachment part 16 eliminates the need for the driving mechanism to move the driving coupling 104 so that it becomes possible to suppress the complication of the structure of the attachment part 16 and to achieve space saving of the attachment part 16.

In the present embodiment, the manipulation member 29 rotates between the first manipulating position and the second manipulating position. On the other hand, in another embodiment, the manipulation member 29 may move linearly between the first manipulating position and the second manipulating position.

In the present embodiment, the shutter 28 is rotatably attached to the outer circumference of the duct 33 of the case main body 21. On the other hand, in another embodiment, the shutter 28 may be rotatably attached to an inner circumference of the duct 33 of the case main body 21.

In the present embodiment, the manipulation member 29 is directly connected to the shutter 28. On the other hand, in another embodiment, the manipulation member 29 may be indirectly connected to the shutter 28 via a separated member.

In the present embodiment, an entire part of the agitator 22 is stored in the case main body 21. On the other hand, in another embodiment, a part of the agitator 22 may be stored in the case main body 21. In the present embodiment, the conveyer 23 except the right end portion is stored in the case main body 21. On the other hand, in another embodiment, an entire part of the conveyer 23 may be stored in the case main body 21.

In the present embodiment, an entire part of the transmitter 25 is arranged outside the case main body 21. On the other hand, in another embodiment, apart of the transmitter 25 may be arranged outside the case main body 21.

In the present embodiment, the configuration of the present disclosure is applied to the printer 1. On the other hand, in still another embodiment, the configuration of the present disclosure may be applied to an image forming apparatus, such as a copying machine, a facsimile and a multifunctional peripheral, other than the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body storing a toner;

a rotator rotating around a rotation axis extending along a rotation axis direction, at least a part of the rotator being stored in the case main body;

a transmitter arranged outside the case main body and transmitting rotation to the rotator;

a moving mechanism which moves the transmitter between a first position and a second position which is arranged at an outside in the rotation axis direction of the first position; and a manipulation member arranged outside the case main body and moving between a first manipulating position and a second manipulating position, wherein as the manipulation member moves from the first manipulating position to the second manipulating position, the moving mechanism moves the transmitter from the first position to the second position, and as the manipulation member moves from the second manipulating position to the first manipulating position, the moving mechanism moves the transmitter from the second position to the first position, the toner case further comprising a cover covering an outside of the case main body in the rotation axis direction, wherein an entire part of the transmitter is retracted to an inside of the cover in a state where the transmitter is in the first position, a part of the transmitter is protruded to an outside in the rotation axis direction further than the cover in a state where the transmitter is in the second position, and the manuipulation member is exposed through a partially flat upper side of the cover.

2. The toner case according to claim 1, further comprising a shutter moving between a closing position where the shutter closes a toner discharge port provided in the case main body and an opening position where the shutter opens the discharge port, wherein as the manipulation member moves from the first manipulating position to the second manipulating position, the shutter moves from the closing position to the opening position, and as the manipulation member moves from the second manipulating position to the first manipulating position, the shutter moves from the opening position to the closing position.

3. The toner case according to claim 1, wherein the transmitter moves linearly along the rotation axis direction between the first position and the second position.

4. A toner case comprising:

a case main body storing a toner;

a rotator rotating around a rotation axis extending along a rotation axis direction, at least a part of the rotator being stored in the case main body;

a transmitter arranged outside the case main body and transmitting rotation to the rotator;

a moving mechanism which moves the transmitter between a first position and a second position which is arranged at an outside in the rotation axis direction of the first position; and a manipulation member arranged outside the case main body and moving between a first manipulating position and a second manipulating position, wherein as the manipulation member moves from the first manipulating position to the second manipulating position, the moving mechanism moves the transmitter from the first position to the second position, and as the manipulation member moves from the second manipulating position to the first manipulating position, the moving mechanism moves the transmitter from the second position to the first position, wherein the moving mechanism includes:

a holder rotating between a first holding position where the holder holds the transmitter in the first position and a second holding position where the holder holds the transmitter in the second position; and a biasing member biasing the holder to the second holding position, and the manipulation member rotates between the first manipulating position and the second manipulating position, wherein as the manipulation member rotates from the first manipulating position to the second manipulating position, the holder simultaneously rotates and moves from the first holding position to the second holding position by biasing force of the biasing member, and as the manipulation member rotates from the second manipulating position to the first manipulating position, the manipulation member presses the holder, the holder simultaneously rotates and moves from the second holding position to the first holding position against the biasing force of the biasing member.

5. The toner case according to claim 4, wherein the holder and the manipulation member rotate around the rotation axis, the holder includes:

a base part formed in a cylindrical shape with the rotation axis as an axis center and holding the transmitter;

an arm part extending from an outer circumferential face of the base part to an outside in a radial direction; and a boss part extending from the arm part to an inside in the rotation axis direction, and the manipulation member includes:

a main body part formed in an annular shape with the rotation axis as a center; and a pressing part extending from an outer circumferential face of the main body part to an outside in a radial direction, wherein as the manipulation member rotates from the second manipulating position to the first manipulating position, the pressing part presses the boss part.

6. The toner case according to claim 4, further comprising a cover covering an outside of the case main body in the rotation axis direction, wherein the cover includes:

a main wall having a through hole; and a guide wall protruding from the main wall at an outer circumference of the through hole to an inside in the rotation axis direction, wherein a part of the holder is inserted into the guide wall.

7. The toner case according to claim 6, wherein a guide part is formed on an edge of the guide wall at an inside in the rotation axis direction, at least a part of the guide part is inclined to an outside in the rotation axis direction from an upstream side to a downstream side in a rotating direction of the holder from the first holding position to the second holding position, and the holder includes a guided part which comes into contact with the part of the guide part.

8. The toner case according to claim 4, further comprising a supporter connected to the rotator, wherein the transmitter is supported by the supporter in a state where the transmitter is movable along the rotation axis direction and is not rotatable with respect to the supporter, and the biasing member is interposed between the supporter and the transmitter.

9. A toner case comprising:

a case main body storing a toner;

a rotator rotating around a rotation axis extending along a rotation axis direction, at least a part of the rotator being stored in the case main body;

a transmitter arranged outside the case main body and transmitting rotation to the rotator;

a moving mechanism which moves the transmitter between a first position and a second position which is arranged at an outside in the rotation axis direction of the first position; and a manipulation member arranged outside the case main body and moving between a first manipulating position and a second manipulating position, wherein as the manipulation member moves from the first manipulating position to the second manipulating position, the moving mechanism moves the transmitter from the first position to the second position, and as the manipulation member moves from the second manipulating position to the first manipulating position, the moving mechanism moves the transmitter from the second position to the first position, wherein the case main body includes a protrusion protruding to an outside in the rotation axis direction, and the manipulation member includes an engaging groove engaged with the protrusion in a state where the manipulation member is in the second manipulating position.

* * * * *